United States Patent [19]

Merrien et al.

[11] Patent Number: 4,712,601

[45] Date of Patent: Dec. 15, 1987

[54] PROCESS AND APPARATUS FOR AUTOMATING A BAKING CYCLE UNDER HOT AIR OF SAND MOLDS

[75] Inventors: Pierre L. Merrien, Billere; Pierre A. Merrien, Sceaux, both of France

[73] Assignee: Etude et Development en Metallurgie, Billere, France

[21] Appl. No.: 755,687

[22] Filed: Jul. 16, 1985

Related U.S. Application Data

[60] Division of Ser. No. 631,521, Jul. 18, 1984, Pat. No. 4,573,522, which is a continuation of Ser. No. 210,623, Nov. 26, 1980, abandoned.

[30] Foreign Application Priority Data

Nov. 28, 1979 [FR] France ..... 79 29227

[51] Int. Cl.[4] ..... B22C 9/14

[52] U.S. Cl. ..... 164/150; 164/154

[58] Field of Search ..... 164/338.1, 456, 12, 164/150, 154

[56] References Cited

FOREIGN PATENT DOCUMENTS 2727794 1/1979 Fed. Rep. of Germany .
2921403 11/1980 Fed. Rep. of Germany .
45-36110 11/1970 Japan .

*Primary Examiner*—Kuang Y. Lin
*Attorney, Agent, or Firm*—Sandler & Greenblum

[57] ABSTRACT

A process and apparatus for automating the hot-air baking of sand molds before casting a sample in the mold using low pressure casting techniques. The process includes dividing the cycle into characteristic phases associated with particular baking parameters, determining and recording the optimal baking parameters associated with each phase and regulating the hot air blown on the mold so as to assure correspondence between the optimal parameters and those actually obtained during an actual baking cycle. The apparatus includes an analysis electrode for measuring the concentration of volatile organic materials evaporating from the mold, a valve for controlling a hot air inlet to the mold, and a pilot apparatus for comparing the theoretical volatile organic material concentration above the mold with the volatile organic material concentration measured by the analysis electrode and for opening and closing the valve, so as to assure correspondence between the actual and the theoretical concentration of volatile organic materials evaporating from the mold. The invention can be used for the baking of foundry molds, and particularly, foundry molds for aeronautical parts.

16 Claims, 3 Drawing Figures

PROCESS AND APPARATUS FOR AUTOMATING A BAKING CYCLE UNDER HOT AIR OF SAND MOLDS

This is a division of application Ser. No. 631,521, filed July 18, 1984, now U.S. Pat. No. 4,573,522, which is a continuation of application Ser. No. 210,623, filed Nov. 26, 1980 (now abandoned).

TECHNICAL FIELD OF THE INVENTION

The present invention relates to an apparatus and method for the regulation of hot air baking of foundry molds for diverse alloys, particularly aluminum, which are adapted to be cast at low pressure.

BACKGROUND OF THE INVENTION

It is known that if one casts molds made out of synthetic sand (silica and zircon for example, connected by organic resins) without heating the molds first, one obtains castings having a substantial risk of faults (i.e., blisters, micropores).

When heating of the molds is performed, the heating of the core of the mold is generally carried out in an oven with a blowtorch. The mold is then assembled and closed before the casting.

However, the heating produced with a blowtorch is irregular and may not contact all of the surfaces of the mold. Further, after a blowtorch is used for heating of the unassembled mold, the volatile organic products evaporated from the mold during heating can return to the mold in the interval of time necessary for the assembly of the mold before casting. Thus, there is a need for a method and an apparatus for heating a sand mold before casting that contacts the entire surface of the mold and which permits a casting in the mold before the evaporated volatile organic products return to the mold.

SUMMARY OF THE INVENTION

It is an object of the present invention to provide an apparatus and method for heating a sand mold before casting that contacts the entire surface of the mold and which permits a casting in the mold before the evaporated volatile organic products return to the mold.

In low pressure casting of sand molds, the metal is injected from the bottom to the top through the lower surface of the mold. In gravity casting, on the other hand, the mold has an orifice on the other side of the mold. Furthermore, the mold, having no deadhead, is without an orifice at the upper portion.

In the first instance it is thus possible to provide at the lower portion of the mold a hot air inlet, as seen in FIG. 1, which permits:

(1) heating of the assembled mold, which is then ready for casting;

(2) radial heating and drying of the mold for pushing the volatile organic products towards the exterior of the mold; and (3) casting immediately after the interruption of the drying.

Because these bakings of the mold are conducted empirically, the times, temperatures, and flow rates used are those which have in the past given good results. They must therefore be established statistically for each type of element that is cast in the mold.

In one embodiment, the invention relates to an automation process for a hot air baking cycle of a sand mold.

The process comprises the steps of dividing the baking cycle inot a plurality of phases, determining optimal baking parameters associated with each of the phases by hot air baking of the sand mold during a development stage, recording the parameters associated with each of the phases, casting a sample in the mold, examining the surface of the sample for microporosities by means of fluorescent sweating, establishing correlations between the recorded parameters and microporosities which exist at the surface of the sample, and regulating a hot air inlet to an oven used in the baking cycle in a manner so as to assure correspondence between the optimal parameters determined and those actually obtained during the performance of the baking cycle.

In another embodiment, the method of the present invention relates to an automation process for a hot air baking cycle of baking a mold, comprising a plurality of phases. The process comprises the steps of determining baking parameters associated with each of the phases by hot air baking of the mold, recording parameters associated with each of the phases, casting a sample in the mold, examining the surface of the sample for microporosities by means of fluorescent sweating, establishing correlations between the recorded parameters and microporosities at the surface of the casting sample, and regulating the hot air inlet to the mold used in the baking cycle in a manner so as to ensure correspondence between the parameters determined and those actually obtained during the performance of the baking cycle. In this embodiment, baking cycle comprises two phases. In the first phase, the volatile product concentration in the air at the upper portion of the mold is greater than or equal to that of an initial value. In the second phase, the volatile product concentration decreases slowly to maintain the mold until the casting of the casting element. In this embodiment, the regulating step is initiated in response to a signal from an analysis electrode for measuring the volatile product concentration.

In still another embodiment, the method of the present invention comprises an automated process for controlling hot air evaporation of volatile organic materials contained in the sand mold which is designed for low pressure casting. The process comprises the steps of separating the evaporation of the volatile organic materials into a plurality of phases, predetermining control parameters associated with the plurality of phases by recording the concentration of the organic materials evaporating from the sand mold over time, establishing correlations between the concentrations over time and microporosities on the surface of the casting sample which is cast in the mold, and regulating the hot air entering the mold in an actual production cycle so that the actual parameters obtained in the course of an actual production cycle conform to the control parameters, whereby the evaporation of the volatile organic materials is carried out under pre-set conditions.

In this embodiment, the predetermining step further comprises pre-determining control parameters comprising the velocity of the decrease in the concentration of the volatile organic materials evaporating from the sand mold as a function of time. The regulating step further comprises regulating the velocity of the decrease in the concentration of the volatile organic materials evaporating from the sand mold in an actual production cycle to ensure conformity between the predetermined velocity and the actual velocity of decease in the concentration of the volatile organic materials evaporating from the sand mold during of actual production cycle. In addition, the process further comprises determining the microporosities on the surface of the casting sample by the process of fluorescent sweating.

In this embodiment, the separating step comprises the steps of separating the evaporation into first and second phases. The first phase comprises a beginning and an end. In the first phase, the concentration of volatile organic materials is in the air that evaporates from the mold after the beginning is at a value higher than the volatile organic material concentration at the beginning of the first phase. In the second phase, the concentration of the volatile organic materials decreases below the value at the beginning of the first phase. In this embodiment, the regulating step begins at the beginning of the second phase in response to a signal from a means for determining the concentration of volatile organic materials in the air evaporating from the mold.

The predetermining step in this embodiment further comprises: heating the mold to vary the decrease in the velocity of evaporation of the volatile organic materials to produce an evaporation curve of the concentration of volatile organic materials over time; examining the external conditions of the casting sample; repeating these two previous steps a plurality of times to produce a plurality of curves; and establishing statistical correlations between the plurality of curves and the results of the examination of the external condition of the mold so as to determine an optimum evaporation curve for the mold, whereby the process uses the minimum amount of time and the minimum amount of energy in heating the mold to obtain a satisfactory casting.

In addition, the regulating step further comprises the steps of: measuring the actual change in the volatile organic materials concentration $\Delta C_R$ over a particular period of time $\Delta T$ and calculating the theoretical organic material concentration $\Delta C_T$ over the period of time $\Delta T$, based on the optimal evaporation curve by formula $\Delta C_T = V_3\ \Delta T$; comparing $\Delta C_R$ and $\Delta C_T$; and passing hot air into the mold if $\Delta C_R$ is less than or equal to $\Delta C_T$, and stopping the passing of hot air into the mold if $\Delta C_R$ is greater than $\Delta C_T$. In this embodiment, the hot air that is cast into the mold has a temperature of approximately 150°.

In still another embodiment the invention relates to an apparatus for ensuring the proper removal of a volatile organic material from a sand mold. The apparatus comprises means for determining the optimal concentration removal rate of a volatile organic material evaporating from the sand mold as a function of time during the drying of sand mold, and means for heating the sand mold before casting in such a manner that the concentration of volatile organic material evaporating from the sand mold as a function of time substantially conforms to the optimal concentration removal rate as a function of time. The determining means discussed above comprises:

(i) means for measuring the concentration of volatile organic materials evaporating from the sand mold as a function of time;

(ii) means for recording the concentration of volatile organic materials evaporating from the sand mold as a function of time;

(iii) means for examining the condition of a sample cast after the concentration of volatile organic materials is recorded. The determining means further comprises:

(iv) means for varying the concentration of volatile organic material evaporating from the sand mold as a function of time;

(v) means for repeating the operations performed by means (i), (ii), (iii), (iv), and a plurality of times to produce a plurality of results and a plurality of evaporation curves representing a plurality of volatile organic concentrations as a function of time, whereby the optimal function of time can be established; and (vi) establishing correlation between the plurality of curves and a plurality of results to obtain the optimal concentration removal rate for producing an optimal result.

In addition, the heating step of this method comprises the step of selectively blowing hot air into the contact with the sand mold. In addition, the blowing means comprises means for blowing hot air into contact with a plurality of sand molds before casting in such a manner that the concentration of volatile organic materials evaporating from the sand molds as a function of time is substantially the same as the optimal volatile organic material concentration. In addition, the blowing means further comprises in this embodiment a source of hot air and a plurality of hot air inlet tubes.

Each hot air inlet tube is connected to the inlet of one of the sand molds and to the source of hot air. Additionally, means are provided means for measuring the concentration of volatile organic materials evaporating from each of the sand molds, together with a plurality of automatic valves, each of the valves being position in a different one of the hot air inlet tubes, and one of the hot air inlet tubes being associated with each of the objects; and means for regulating the opening and closing of the plurality of automatic valves in such a manner that the concentration of volatile organic materials evaporating from the plurality of sand molds as a function of time substantially conforms to the optimal volatile organic material as a function of time.

The measuring means comprises means for measuring the actual change in the concentration of volatile organic material $\Delta C_R$ evaporating from the object over a particular period of time $\Delta T$. The apparatus further comprises means for calculating the change in the optimal concentration of volatile organic material $\Delta C_T$ evaporating from the object over a period of time $\Delta T$, by the formula $\Delta C_T = V_3\ \Delta T$, where $V_3$ comprises the velocity of the decrease in the optimal concentration removal rate. In addition, the comparing means comprises means for comparing $\Delta C_R$ with $\Delta C_T$.

The adjustment means comprises means for blowing hot air into contact with the object if $\Delta C_R$ is less than $\Delta C_T$ and a means for preventing the blowing of hot air into contact with the object if $\Delta C_R$ is greater than $\Delta C_T$. The adjusting means provides for blowing of hot air into contact with the object when $\Delta C_r$ is equal to $\Delta C_T$.

DETAILED DESCRIPTION OF PREFERRED EMBODIMENTS

The present invention regulates the hot air baking of the mold in such a manner so as to minimize the heating time and intensity, making it possible to assure satisfactory conditions before low pressure molding.

The invention is directed to a process and an apparatus for its application.

The process includes dividing the baking operation into various phases and determining baking parameters for each phase.

Figure 2:
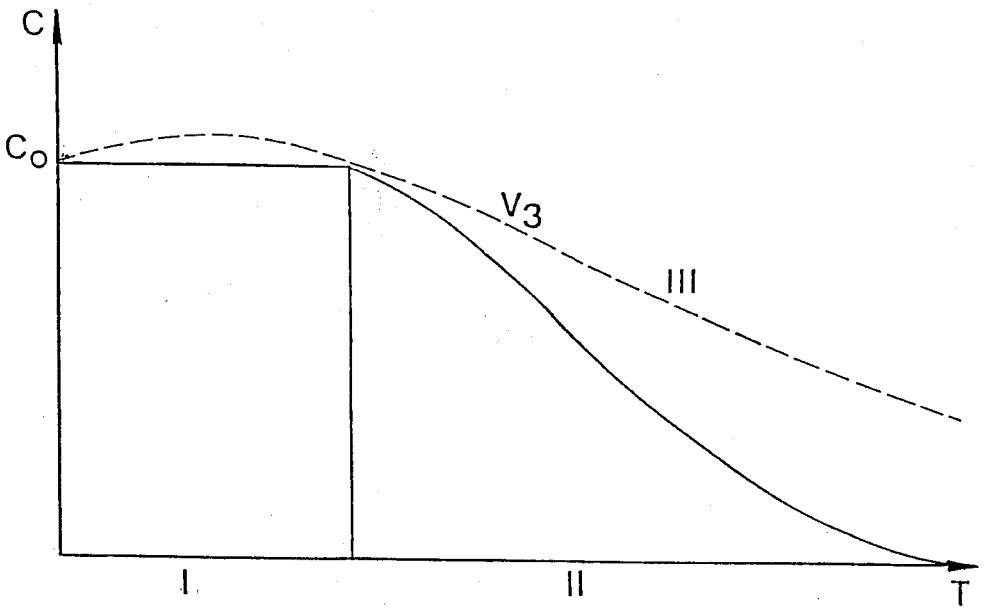
FIG. 2 is a graphical representation of an evaporation curve for volatile organic materials.

Hot air baking of said molds under low pressure comprises two essential phases represented in FIG. 2.

Figure 1:
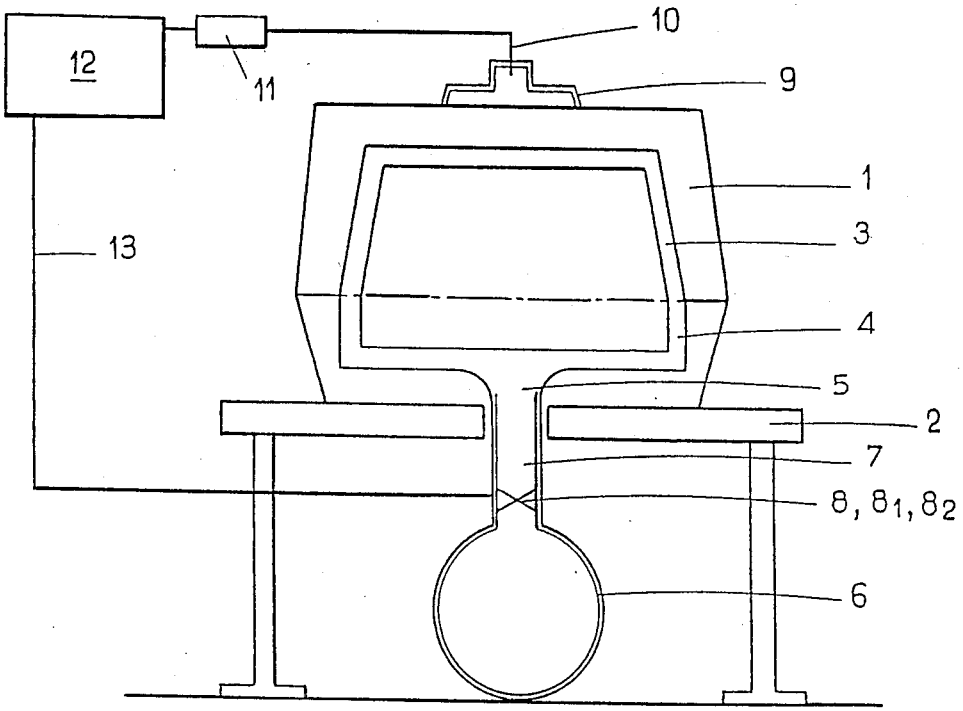
FIG. 1 illustrates a device for the hot-air baking of foundry molds for various alloys.

The curve in FIG. 2 represents, as a function of time, the organic volatile materials concentration in the air leaving the upper surface of mold A in FIG. 1.

During Phase I, the concentration of volatile materials remains substantially constant, or rises and then returns to its original value.

During Phase II, the concentration decreases from this original value to the value 0.

In the present invention one replaces phase II, which describes the typical decrease in the concentration of volatile organic materials evaporating from the mold, with a phase III in which the concentration of volatile organic materials evaporating from the mold decreases more slowly than in phase II.

This slow speed of decrease of concentration during Phase III assures appropriate maintenance of the sample before casting. Slowing the speed of decrease in the concentration of volatile organic materials evaporating from the mold is performed by blowing hot air into the mold through a hot air inlet, which is controlled by a pilot apparatus. Data on an optimal decrease in the concentration of volatile organic materials evaporating from the mold is introduced into the pilot apparatus. The pilot apparatus, in turn, controls an automated valve in the hot air inlet for assuring that the actual decrease in concentration of the volatile organic materials evaporating from the mold conforms to the optimal decrease in the concentration of volatile organic materials evaporating from the mold.

The embodiment according to FIG. 1 includes:

(1) a sand mold (1);
(2) placed on a plate (2);
(3) with its impression (3);
(4) its casting system (4);
(5) its inlet cone (5);
(6) a hot air line (6);
(7) an air inlet tube into the mold (7);
(8) an automated valve (8);
(9) a measurement device with a hood (9);
(10) an analysis electrode (10);
(11) a volatile organic material concentration recorder (11);
(12) an automation pilot (12); and
(13) a control circuit (13) for controlling valve (8) which is controlled by pilot (12).

Pilot 12 comprises:

(1) an inlet-outlet assembly;
(2) a calculator assembly; and
(3) a memory assembly, and can comprise microprocessors and electronic clocks.

The parameters of the base curve of FIG. 2 are introduced in the inlet-outlet assembly, i.e.:

(1) the speed $V_3$ of diminution of the volatile material concentration;
(2) the interval of time measured $\Delta T$; and
(3) the volatile material concentration which at the start $C_O$, is taken as 0 in the system.

The calculator assembly performs the following functions:

(1receives the variation in time $\Delta T$ of the volatile organic material concentration, which is represented by $\Delta C_R$.

(2) it calculates the theoretical variation in the concentration of organic materials evaporating from the mold for the same interval $\Delta T$ by the formula:

$$\Delta C_T = V_3 \Delta T;$$

Figure 3:
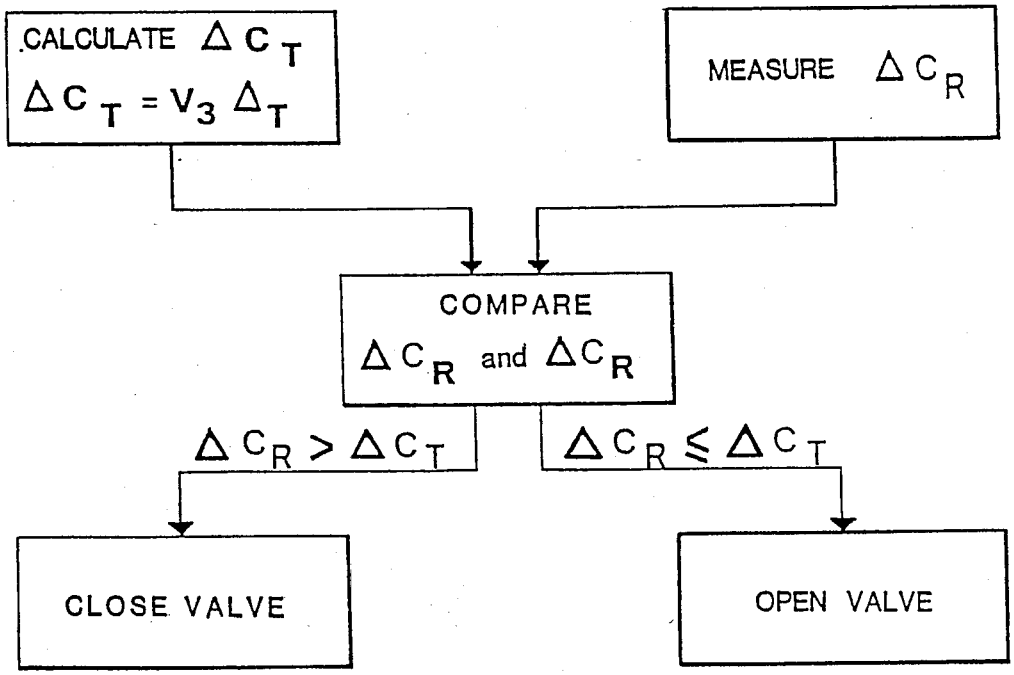
FIG. 3 is a block diagram of a pilot of the apparatus according to the present invention.

(3) it compares $\Delta C_R$ and $\Delta C_T$; and
(4) it controls:
(a) the closing of the automated valve if $\Delta C_R > \Delta C_T$; and
(b) the opening of the valve if $\Delta C_R \leqq \Delta C_T$ The regulation assembly is shown by the schematic diagram in FIG. 3.

Pilot 12 can receive information from several driers and regulate them in the same manner as for a single dryer using automated valves $8_1$ - $8_2$ - $8_3$. The inlets of the molds are all shunted on central hot air line 6.

The memory assembly receives and stores various values for speeds $V_3$ suited for different types of elements.

The apparatus is used as follows. First, the theoretical concentration of volatile organic materials evaporating from the mold that is necessary for a satisfactory casting for a particular alloy is determined. This is accomplished by performing a number of castings in which different amounts of hot air are used to dry the mold before each casting. The drying curves (i.e., the curves representing the concentration of volatile organic materials evaporating from the mold over time) associated with each casting are recorded and these curves are compared to the quality of each casting. The quality of each casting is determined by examining the microporosities in each cast sample by the technique of fluorescent sweating. As a result of this comparison the optimal drying curve is determined for producing the best casting for a particular alloy to be cast.

After the optimal theoretical drying curve is determined, other samples made of the same alloy can be cast by heating the mold before casting in such a manner that the actual concentration of volatile organic materials evaporating from the mold over time conforms to the theoretical concentration of volatile organic materials evaporating from the mold over time. This is accomplished by analysis electrode 10 feeding information on the actual concentration to pilot 12, which compares the theoretical concentration with the actual concentration measured by electrode 10 and either opens or closes valve 8 so that these two concentrations are the same.

The temperature of the air can, for example, be in the range of 150° C.

We claim:

1. An apparatus for ensuring the proper removal of volatile organic materials from a sand mold, wherein said apparatus comprises:

(a) means for determining the optimal concentration of volatile organic materials evaporating from said sand mold as a function of time during the drying of said sand mold;
(b) means for heating said sand mold before casting in such a manner that the concentration of volatile organic materials as a function of time evaporating from said mold during drying before casting is substantially the same as said optimal volatile organic material concentration as a function of time.

2. The apparatus defined by claim 1 wherein said heating means comprises means for selectively blowing hot air into contact with said sand mold.

3. The apparatus defined by claim 2 wherein said determining means comprises:

(i) means for measuring the concentration of volatile organic materials evaporating from said sand mold as a function of time;

(ii) means for recording said concentration of volatile organic materials evaporating from said sand mold as a function of time;

(iii) means for examining the condition of a sample cast after said concentration of volatile organic materials is recorded.

4. The apparatus defined by claim 3 wherein said determining means further comprises:

(iv) means for activating the means of steps (i), (ii), (iii) a plurality of times to produce a plurality of evaporation curves representing a plurality of volatile organic material concentrations as a function of time, whereby said optimal volatile organic material concentration as a function of time is determined by correlating the condition of said samples with said plurality of evaporation curves.

5. The apparatus defined by claim 2 further comprising:

(c) means for measuring the concentration of volatile organic materials evaporating from said sand mold as a function of time so as to produce a measured concentration of volatile organic materials evaporating from said sand mold over time;

(c) means for comparing said measured concentration with said optimal concentration of volatile organic material evaporating from said sand mold as a function of time; and (d) means for adjusting the flow of said blowing hot air so that said measured concentration of volatile organic materials evaporating from said sand mold as a function of time is substantially the same as said optimal concentration of volatile organic materials evaporating from said sand mold as a function of time.

6. The apparatus defined by claim 5 wherein said measuring means comprises means for measuring the change in concentration of volatile organic materials $\Delta C_R$ evaporating from said sand mold over a particular period of time $\Delta T$, wherein said apparatus further comprises means for calculating the change in the optimal concentration of volatile organic material $\Delta C_T$ evaporating from said sand mold over said period of time $\Delta T$, by the formula $\Delta C_T = V_3 \Delta T$, wherein $V_3$ comprises the speed of decrease in the optimal concentration of volatile organic material evaporating from said sand mold, and wherein said comparing means comprises means for comparing $\Delta C_R$ and $\Delta C_T$.

7. The apparatus defined by claim 6 wherein said adjusting means comprises means for opening the flow of hot air into said mold if $\Delta C_R < \Delta C_T$, and means for opening the flow of hot air into said sand mold if $\Delta C_R > \Delta C_T$.

8. The apparatus defined by claim 7 wherein said adjusting means comprises means for opening the flow of hot air into said sand mold when $\Delta C_R = \Delta C_T$ as compared to when $\Delta C_R > \Delta C_T$.

9. The apparatus defined by claim 2 wherein said blowing means comprises means for producing hot air having a temperature of approximately 150° C.

10. The apparatus defined by claim 2 wherein said blowing means comprises:

(i) a hot air line connected to a source of hot air;

(ii) an air inlet tube connecting said hot air line to an inlet to said sand mold;

(iii) an automated valve positioned in said air inlet tube; and wherein said apparatus further comprises a measurement electrode for measuring the concentration of volatile organic materials evaporating from said sand mold.

11. The apparatus defined by claim 10 wherein said measurement electrode is positioned above said sand mold.

12. The apparatus defined by claim 10 wherein said blowing means further comprises:

(iv) an automatic pilot for regulating the opening and closing of said automated valve, wherein said automatic pilot comprises:

(aa) a memory for storing said optimal volatile organic concentrations as a function of time;

(bb) a calculator means for: calculating the optimal volatile organic material concentration in an interval $\Delta T$ by the relation $\Delta C_T = V_3 \Delta T$, herein $V_3$ comprises the speed of decrease in the optimal concentration of volatile organic material evaporating from said sand mold; receiving information from said measurement electrode on the concentration of volatile oraganic materials $\Delta C_R$ evaporating from said sand mold over time period $\Delta T$; comparing $\Delta C_R$ and $\Delta C_T$; and closing said automated valve if $\Delta C_R > \Delta C_T$, and opening said valve if $\Delta C_R < \Delta C_T$.

13. The apparatus as defined by claim 12 wherein said calculator means further comprises means for opening said automated valve when $\Delta C_r$ changes from being greater than $\Delta C_T$ to being equal to $\Delta C_T$.

14. The apparatus defined by claim 2 wherein said blowing means comprises means for blowing hot air into contact with a plurality of sand molds before casting in such a manner that the concentration of volatile organic materials as a function of time evaporating from said sand molds is substantially the same as said optimal volatile organic material concentration.

15. The apparatus defined by claim 14 wherein said blowing means further comprises a source of hot air and a plurality of hot air inlet tubes, wherein each hot air inlet tube is connected to the inlet of one of said sand molds and to said source of hot air.

16. The apparatus defined by claim 15 wherein said blowing means further comprises:

means for measuring the concentration of volatile organic materials evaporating from each of said sand molds;

a plurality of automatic valves, each of which is positioned in a different one of said hot air inlet tubes; and means for regulating the opening and closing of said plurality of automatic valves, connected to said measuring means, wherein said regulating means regulates the opening and closing of said plurality of automatic valves in such a manner that the concentration of volatile organic materials evaporating from said plurality of sand molds as a function of time is substantially equal to the optimal volatile organic material concentration as a function of time.

* * * * *

UNITED STATES PATENT AND TRADEMARK OFFICE

CERTIFICATE OF CORRECTION

PATENT NO. : 4,712,601

DATED : December 15, 1987

INVENTOR(S) : Pierre L. MERRIEN et al.

It is certified that error appears in the above-identified patent and that said Letters Patent is hereby corrected as shown below:

At column 2, line 2, change "inot" to ---into---.

At column 2, line 17, change "of" after "cycle" to "for".

At column 2, line 67, change "decease" to ---decrease---.

At column 3, line 9, delete "is" after "materials".

At column 4, line 27, delete "means" after "provided".

At column 5, line 8, change "said" to ---sand---.

At column 6, line 3, change "(lreceives" to ---(1) receives---.

At column 7, line 63, change "opening" to ---closing---.

At column 8, line 30, change "oraganic" to ---organic---.

Signed and Sealed this

Twenty-fourth Day of January, 1989

*Attest:*

*Attesting Officer*

DONALD J. QUIGG

*Commissioner of Patents and Trademarks*